US005499606A

United States Patent [19]

Robnett et al.

[11] Patent Number: 5,499,606

[45] Date of Patent: Mar. 19, 1996

[54] VARIABLE TIMING OF MULTIPLE ENGINE CYLINDER VALVES

[75] Inventors: James T. Robnett, Royal Oak; Mark R. Molitor, Muskegon, both of Mich.

[73] Assignee: Siemens Automotive Corporation, Auburn Hills, Mich.

[21] Appl. No.: 371,185

[22] Filed: Jan. 11, 1995

[51] Int. Cl.[6] ..... F01L 9/02; F01L 13/00

[52] U.S. Cl. ..... 123/90.12; 123/90.16

[58] Field of Search ..... 123/90.11, 90.12, 123/90.13, 90.15, 90.16, 90.17, 90.48, 90.22, 90.27

[56] References Cited

U.S. PATENT DOCUMENTS 4,615,306 10/1986 Wakeman ..... 123/90.16
4,887,562 12/1989 Wakeman ..... 123/90.12
4,930,465 6/1990 Wakeman et al. ..... 123/90.12
5,154,143 10/1992 Stutzenberger ..... 123/90.12
5,158,048 10/1992 Robnett et al. ..... 123/90.16
5,216,988 6/1993 Taxon ..... 123/90.12

*Primary Examiner*—Weilun Lo
*Attorney, Agent, or Firm*—Russel C. Wells

[57] ABSTRACT

Lost motion variable valve timing systems using hydraulic actuators controlled by a single control valve, preferably an electronically controlled solenoid valve, for actuating two or more valves on similar or identical timing and lift curves include prevention means that stop discharge pulses from one actuator being transmitted to and adversely affecting another actuator connected to the same control valve. Such prevention means may include one way check valves in the discharge lines connected with the control valve, non-aligned multiple inlet ports in the control valve and positioned to avoid transfer of pulses from one inlet port to another, or other return pulse preventing means.

9 Claims, 2 Drawing Sheets

VARIABLE TIMING OF MULTIPLE ENGINE CYLINDER VALVES

FIELD OF THE INVENTION

This invention relates to engines with variable valve timing control systems using commonly controlled hydraulic lost motion valve actuators suitable for electronic control. In preferred embodiments, the invention relates to systems for common control of multiple actuators driving valves associated with a single cylinder of an engine.

BACKGROUND OF THE INVENTION

It is known in the engine art to actuate valves with lost motion hydraulic actuators in place of conventional valve lifters and to provide a solenoid control valve, preferably with electronic control, for controlling the intake of fluid to and/or exhaust of fluid from the hydraulic actuators for varying the timing and/or lift of the valves in a desired manner. Systems and actuators for accomplishing such purposes are well known in the prior art. For example:

U.S. Pat. No. 4,615,306 Wakeman issued Oct. 7, 1986, shows multiple valves, associated with different engine cylinders and acting with different cam lift timings, having actuators which are controlled by a single solenoid valve and wherein discharged fluid is recirculated to the intakes of the other actuators;

U.S. Pat. No. 4,887,562 Wakeman, issued Dec. 19, 1989, discloses multiple intake or exhaust valves of a single cylinder actuated by a single cam through a combined actuator including dual actuating pistons with a hydraulic connection between them;

U.S. Pat. No. 4,930,465 Wakeman et al. shows a system in which each valve is controlled by a separate actuator and an associated solenoid valve, and fluid is both discharged from and delivered to each actuator through the same conduit;

U.S. Pat. No. 5,158,048 Robnett et al. discloses an actuator construction including damping; and U.S. Pat. No. 5,216,988 Taxon illustrates an actuator arrangement for overhead cam engines with a system wherein inlet fluid is fed to the actuators separately from the discharge fluid that is controlled by an electronically actuated solenoid valve.

Of these patents, only 4,887,562 contemplates driving two similarly timed valves in the same cylinder with a common control valve. But it includes provision of hydraulic actuating means in place of more conventional engine components. Alternative means, requiring less modification of an engine to accommodate lost motion control of multiple valves in a single cylinder having identical or similar valve open periods, are considered desirable.

In the development of such arrangements, we proposed a system, shown in FIG. 1 of the drawings, in which an engine 10 having a plurality of cylinders 12 is provided with at least two inlet valves 14 for each cylinder. The valves 14 are each actuated by a separate hydraulic actuator 16 driven by a separate cam 18, both cams being preferably located on the same camshaft and having identical lift curves. The actuators shown are, for example, of the type shown in U.S. Pat. No. 5,216,988, but could be of any suitable type having a similar function. The valves 14 could instead be exhaust valves and the cams 18 could have overlapping valve timing with slightly different lift curves if desired, although identical opening times and lift curves are intended in the present instance.

Fluid, such as engine oil, is provided from a pressure source, such as the engine oil system, through a check valve 20 and inlet passage 22 connecting with one of the actuators 16. A connecting passage 24 extends between the two actuators 16 to carry fluid from one to the other. A discharge passage 26 connects the other of the actuators 16 with a solenoid valve 28. When opened, valve 28 discharges oil from the actuators to a sump 30 of the engine oil system.

The solenoid valve is preferably controlled by an electronic control unit, not shown, in a manner similar to that indicated in the previously discussed patents. Thus, when the solenoid valve is closed, the actuators 16 are filled with hydraulic fluid which is trapped therein. The trapped fluid provides a hydraulic link through which the actuators 16 are able to actuate the valves 14 with the lift and timing predetermined by the lift curves of their respective cams 18. In order to vary the valve timing and/or lift, the solenoid valve 28 is actuated at predetermined intervals to allow the discharge of oil from the system, collapsing the hydraulic link and allowing the valves 14 to be closed by their respective valve springs 32, not shown. Subsequent closure of the solenoid valve 28 allows refilling of the actuators 16, allowing them to again open the valves 14 on the following cycle.

While the arrangement disclosed above appears adequate for obtaining the desired results, it was found in testing such an arrangement that pressure pulses developed in the system were transmitted between the two hydraulically linked actuators 16 and caused erratic valve opening and closing action of the valves 14. An improved system retaining the features of simplicity and low cost was accordingly desired.

SUMMARY OF THE INVENTION

The present invention provides improved arrangements for actuating multiple valves, preferably of a single cylinder of an engine, wherein actuation of the valves on the same or similar valve opening cycles is desired. Two or more actuators driven by separate cams and each actuating a separate valve are provided as before and both are controlled by a single solenoid valve. However, the solenoid valve is placed hydraulically between the actuators and prevention means are provided for separating the hydraulic effects of the two actuators to avoid hydraulic interference between them.

In one embodiment of the invention, discharge flow from the actuators is provided to a solenoid valve having separate inlet ports which are internally misaligned to avoid hydraulic interference of the entering fluid flows. In another embodiment of the invention, a single intake solenoid valve is used with one-way check valves in the discharge lines leading from two or more actuators to the solenoid valve, thus interrupting any return flow pulses which may otherwise affect operation of the actuators.

These and other features and advantages of the invention will be more fully understood from the following description of certain exemplary embodiments of the invention taken together with the accompanying drawings.

DETAILED DESCRIPTION OF THE INVENTION

Figure 2:
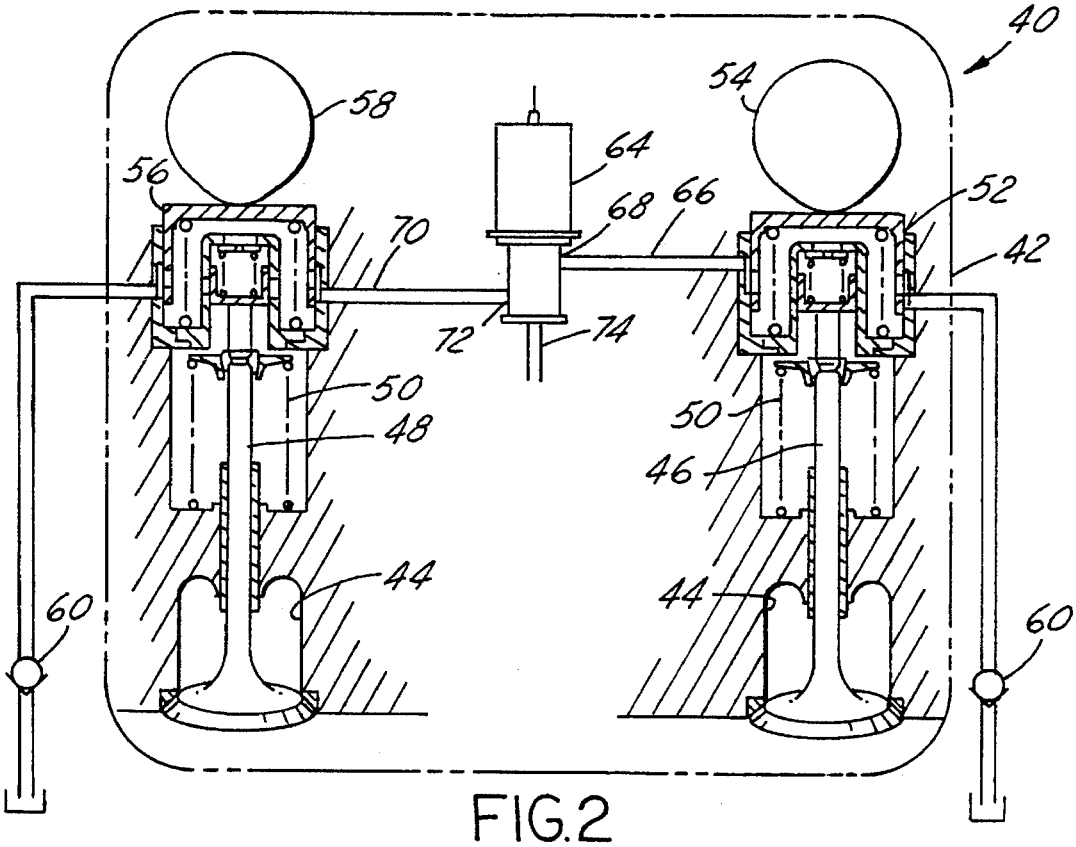
FIG. 2 is a schematic view of an engine with a hydraulic actuator control system comprising a first embodiment of the invention.

Referring first to FIG. 2 of the drawings, there is shown an o engine generally indicated by numeral 40 and including multiple cylinders 42, only one of which is shown. Associated with each of the cylinders are inlet ports 44, two for each cylinder, controlled by separate inlet valves 46, 48 normally held closed by conventional valve springs 50. A hydraulic actuator 52 driven by a cam 54 is provided for opening the valve 46 while an identical hydraulic actuator 56 and cam 58 are provided for opening the valve 48. Both cams are preferably mounted on the same camshaft and have identical timing and lift curves, although the use of cams with slightly differing timing and lift curves is considered within the scope of the invention.

Fluid, such as engine lubricating oil, is provided to both actuators 52, 56 from a pressure source, such as the engine lubricating oil system, through check valves 60 and inlet passages 62 to the inlets, not shown, of the respective actuators. The actuators 52, 56 may be of the sort shown in the previously mentioned U.S. Pat. No. 5,21 6,988 or any other suitable lost motion actuator arrangement of the sort found in the prior art.

Discharge ports, not shown, of the actuators 52, 56 are connected with a solenoid valve 64. Actuator 52 is connected through a discharge passage 66 leading to a first inlet port 68 of valve 64 while actuator 56 is connected through a discharge passage 70 with a second inlet port 72 of the solenoid valve 64. As indicated in the drawings, the inlet ports 68, 72 of the valve 64 are misaligned so that they are internally arranged to enter a discharge chamber, not shown, at differing non-opposed points. The discharge chamber within the solenoid valve connects through a valve element, not shown, with an exhaust passage 74 when the valve is in the open position.

In operation of the engine, the camshaft is conventionally driven at one revolution per engine cycle to actuate each of the engine valves once per cycle. While the solenoid valve remains closed, pressure oil fills the actuators and provides a solid link through which the cams 54, 58 may actuate their respective associated valves 46, 48 with the timings provided by the respective cams. These valve timings may be identical as to opening time and lift curve although similar overlapping valve timings with slightly different opening times and/or lift curves are also contemplated.

When modification of the valve closing time is desired, for example, the solenoid valve 64 is actuated in known manner, as disclosed in the prior art patents previously mentioned, to open at a desired point in the valve open period. This allows the valve springs 50 to close the valves 46, 48 by compressing the actuators 52, 56 and pushing hydraulic fluid out of the actuators in sufficient volume to allow the valves to close at a predetermine rate. The discharged fluid is transferred through the discharge passages 66, 70 and inlet ports 68, 72 to the solenoid valve discharge chamber, not shown, from which it is passed into the exhaust passage 74. Discharge of fluid from the actuators 52, 56 ceases when the valves 46, 48 are seated or when the solenoid valve 64 is closed, after which pressure in the lubricating oil system of the engine is again allowed to fill the actuators with pressure fluid for normal valve actuation on the next cycle.

Figure 1:
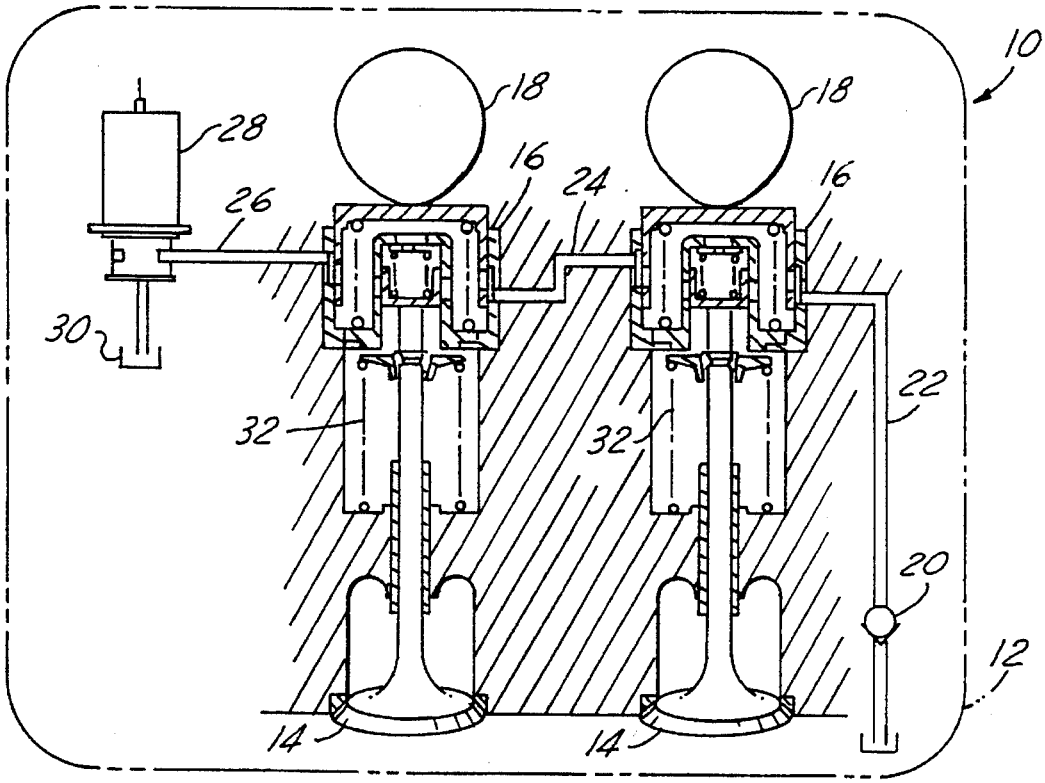
FIG. 1 is a schematic view of an engine having the earlier developed system described above.

Transfer of pressure pulses from one of the actuators 52, 56 to the other is prevented in this system by misalignment of the separate intake ports 68, 72 in the solenoid valve which is arranged internally to dissipate the pulses within the discharge chamber without causing their transfer from the discharge passage of one solenoid valve to that of the other. The system therefore overcomes the problems discovered in testing of the earlier developed arrangement illustrated in FIG. 1.

Figure 3:
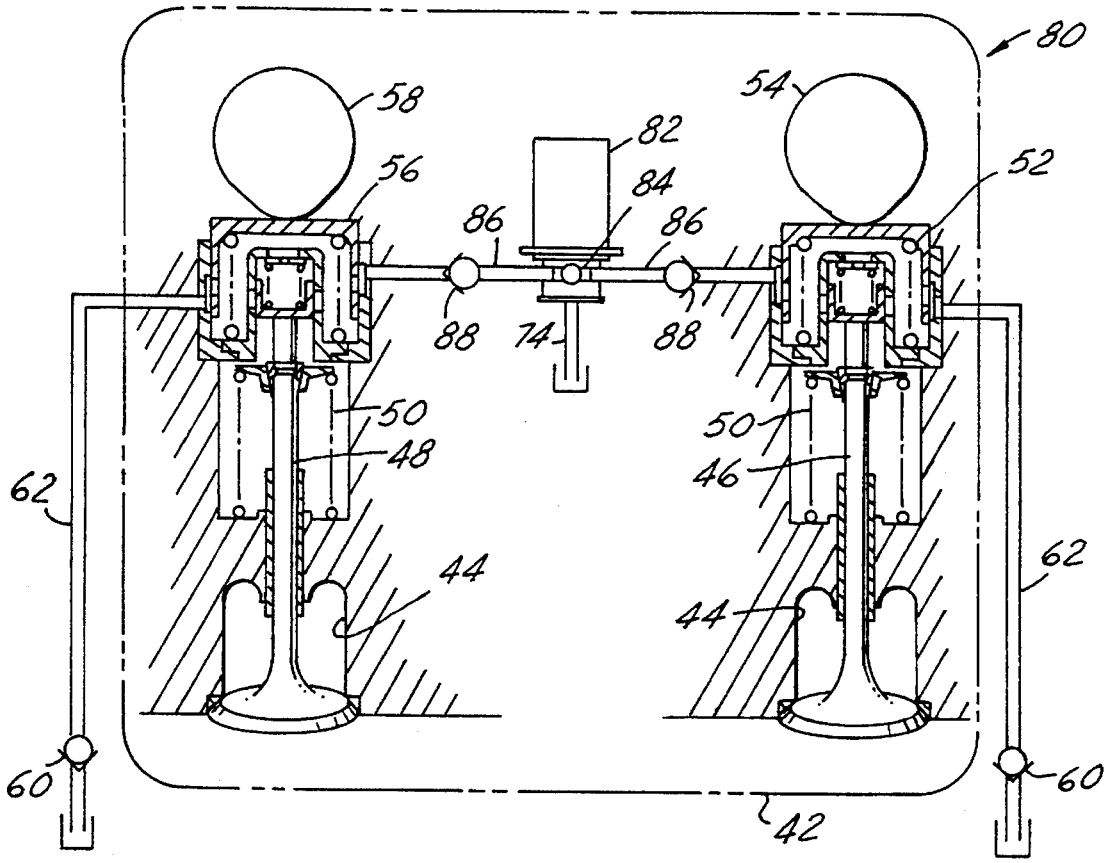
FIG. 3 is a schematic view showing an engine with a second embodiment of hydraulic actuator control system according to the invention.

Referring now to FIG. 3 of the drawings, there is shown an alternative embodiment of the invention in an engine generally indicated by numeral 80. Since many of the features of the embodiment of FIG. 3 are identical to those illustrated in FIG. 2, like numerals are used for like parts. The embodiment of FIG. 3 differs in the use of a conventional solenoid valve 82 having only a single inlet port 84 to which each of the actuators 52, 56 is connected by a discharge passage 86 in which a one-way check valve 88 is provided. The check valves 88 allow flow in one direction only from the actuators 52, 56 toward the solenoid valve 82.

The operation of the system of FIG. 3 is similar to that of FIG. 2, except that the prevention means by which pressure pulses from actuator 52 or 56 are prevented from reaching the other is changed. In this instance, the check valves 88 located in the discharge passages 84 prevent the reverse flow of fluids or pulses of pressure from the single inlet port 84 of the conventional solenoid valve 82 back to either of the actuators 52, 56. In this way, the alternative embodiment of FIG. 3 also solves the problem discovered with the original arrangement of FIG. 1, that is, the problem of pressure pulse interference with the operation of the actuators 16 of the original system.

While the disclosure of the embodiments just described has been primarily directed to the use of cams actuating inlet valves on a single cylinder of an engine in which the cams have identical timing and lift curves, it is within the scope of the invention to utilize more than two valves in the cylinder, each actuated by separate actuators and cams, or to control exhaust valves in multiples instead of inlet valves. Also the use of valve timings including cam lift curves which are similar, in that they overlap but do not necessarily follow exactly the same curves or have the same opening and closing points, is also considered to be within the scope of the invention. The use of other forms of actuators or control valves, such as solenoid valves, is also contemplated.

While the invention has been described by reference to various specific embodiments, it should be understood that numerous changes may be made within the spirit and scope of the inventive concepts described. Accordingly, it is intended that the invention not be limited to the described embodiments, but that it have the full scope defined by the language of the following claims.

What is claimed is:

1. An engine including at least one cylinder with multiple valves controlling access to one of said at least one cylinder and cams having at least similar timing, one of the cams respectively associated with each of said valves for actuating the valves open during common periods; and a variable valve timing system for controlling the actuation of said valves, said system characterized by:

a lost motion hydraulic actuator operatively disposed between each of the valves and its associated cam for causing and maintaining opening of its respective valve in response to cam actuation through a body of trapped fluid while maintained therein, each actuator being connected with fluid inlet and outlet means that are connected in turn with a source of fluid;

one way valve means in the inlet means of each actuator and preventing outlet flow therethrough;

a single hydraulic outlet control valve connected with the outlet means of all of said actuators; and prevention means associated with at least one of said control valve and said outlet means for preventing the transfer of pressure pulses from the outlet means of one actuator to another actuator through its outlet means.

2. An engine as in claim 1 wherein said prevention means are characterized by:

separate non-aligned inlet openings in said control valve positioned to avoid the transfer of significant pressure pulses between said inlet openings, said inlet openings being connected with said actuator outlet means.

3. An engine as in claim 1 wherein said prevention means are characterized by:

one way valve means in each of said actuator outlet means and preventing substantial reverse flow of fluid to any of said actuators from said control valve.

4. An engine as in claim 1 characterized in that:

said multiple valves consist of two valves.

5. An engine as in claim 4 wherein said prevention means are characterized by:

separate non-aligned inlet openings in said control valve positioned to avoid the transfer of significant pressure pulses between said inlet openings, said inlet openings being connected with said actuator outlet means.

6. An engine as in claim 4 wherein said prevention means are characterized by:

one way valve means in each of said actuator outlet means and preventing substantial reverse flow of fluid to either of said actuators from said control valve.

7. An engine as in claim 4 characterized in that:

the timing of the cams actuating said two valves is substantially identical.

8. A combination including multiple valves controlling access to one of at least one cylinder in an engine and cams having at least similar timing, one of the cams respectively associated with each of said valves for actuating the valves open during common periods; and a variable valve timing system in said engine for controlling the actuation of said valves, said system characterized by:

a lost motion hydraulic actuator operatively disposed between each of the valves and its associated cam for causing and maintaining opening of its respective valve in response to cam actuation through a body of trapped fluid while maintained therein, each actuator being connected with fluid inlet and outlet means that are connected in turn with a source of fluid;

one way valve means in the inlet means of each actuator and preventing outlet flow therethrough;

a single hydraulic outlet control valve connected with the outlet means of all of said actuators; and prevention means associated with at least one of said control valve and said outlet means for preventing the transfer of pressure pulses from the outlet means of one actuator to another actuator through its outlet means.

9. A combination as in claim 8 characterized in that:

said multiple valves that are open during common periods and controlled by the same control valve are associated with the same cylinder.

* * * * *